United States Patent [19]

Shinomiya

[11] Patent Number: 4,603,290

[45] Date of Patent: Jul. 29, 1986

[54] CONSTANT-CURRENT GENERATING CIRCUIT

[75] Inventor: Kohji Shinomiya, Kawanishi, Japan

[73] Assignee: Mitsubishi Denki Kabushiki Kaisha, Tokyo, Japan

[21] Appl. No.: 687,000

[22] Filed: Dec. 27, 1984

[30] Foreign Application Priority Data

Dec. 29, 1983 [JP] Japan ..... 58-250243
Mar. 16, 1984 [JP] Japan ..... 59-51865

[51] Int. Cl.[4] ..... G05F 3/16

[52] U.S. Cl. ..... 323/315; 323/901; 323/907

[58] Field of Search ..... 323/312, 315, 316, 901, 323/907; 307/296 R, 297, 310

[56] References Cited

U.S. PATENT DOCUMENTS

| | | | |
|---|---|---|---|
| 3,886,435 | 5/1975 | Steckler | 323/315 |
| 4,051,392 | 9/1977 | Rosenthal et al. | 323/901 X |
| 4,352,057 | 9/1982 | Okada et al. | 323/315 |
| 4,472,675 | 9/1984 | Shinomiya | 323/314 |
| 4,473,794 | 9/1984 | Early et al. | 323/315 |

*Primary Examiner*—Peter S. Wong
*Attorney, Agent, or Firm*—Birch, Stewart, Kolasch & Birch

[57] ABSTRACT

A constant-current generating circuit for supplying a constant current independently of any variations in the source voltage, and further having the true thermal characteristic of the base-emitter voltage of a transistor is constituted in such a manner that the base-emitter voltage of a first transistor is precisely converted into a current, and this current is used as a current source. Another constant-current generating circuit operable at a relatively low source voltage, and capable of minimizing a possible error in supplying a current to the load even when the d.c. current amplification factor of a load-current supplying transistor is low is constituted in such a manner that the emitter of a second transistor which constitutes a negative feedback circuit in combination with a first transistor for generating a constant voltage is connected, directly or via a resistance, to the earthing terminal, and the collector current of a third transistor which constitutes a current mirror circuit in combination with a fifth load-current supplying transistor is controlled by the negative feedback circuit.

8 Claims, 8 Drawing Figures

CONSTANT-CURRENT GENERATING CIRCUIT

FIELD OF THE INVENTION

The present invention relates to a constant-current generating circuit for supplying a constant current regardless of variations in the source voltages, and dependent on the thermal characteristic of the voltage between the base and emitter of a transistor.

BACKGROUND OF THE INVENTION

The constant-current generating circuits commonly in use are designed to stabilize the current value against variations in the source voltage, and undergo thermal compensation so as to keep the constant current value regardless of changes in the ambient temperatures. The known circuits utilize an extrapolated voltage value of an energy band gap in silicon, thereby ensuring that the circuits supply constant voltage or current independently of temperatures. To this end, however, a current must be produced which is dependent on temperature coefficients of the voltage between the base and emitter (hereinafter referred to as "base-emitter voltage") of a transistor.

To produce such a current, under the conventional practice a circuit shown in FIG. 1 is employed. The circuit is designed to stabilize the current independently of variations in the source voltages, and to produce a current dependent on the base-emitter voltage of a transistor against the ambient temperatures. In other words, the circuit is designed to produce a current having a negative temperature coefficient dependent on the temperature coefficient of the base-emitter voltage "VBE" of a transistor.

In FIG. 1 a first transistor Q1 and a second transistor Q2 are NPN types, whereas a third and a fourth transistors Q3 and Q4 are PNP types. The base of the first transistor Q1 and the emitter of the second transistor Q2 are connected to one of the terminals of a first resistance R1, and the collector of the first transistor Q1 is connected to the base of the second transistor Q2 and one of the terminals of a resistance R0. The collector of the second transistor Q2 is connected to the collector and base of the third transistor Q3, and to the base of a fifth transistor Q5. The emitter of the first transistor Q1 is connected to the other terminal of the first resistance R1, and the junction is connected to an earthing terminal GND which is a first potential point. The other terminal of the resistance R0 is connected to the emitters of the third transistor Q3 and of the fifth transistor Q5, the junction of which is connected to a source terminal Vcc which is a second potential point. A power supply is provided between the earthing terminal GND and the source terminal Vcc, so as to operate the circuit. The collector of the fifth transistor Q5 is connected to an output terminal "OUTPUT", and a load L is connected between the "OUTPUT" and the earthing terminal GND. A current is supplied to the load L.

The circuit is operated as follows:

When the power is turned on, a current flows through the base of the second transistor Q2 via the resistance R0, and passes through the emitter thereof. The current flows through the first resistance R1 and the base of the first transistor Q1, and eventually reaches the earthing terminal GND. In this way the circuit starts to operate. As a result a negative feedback is effected by the first and the second transistor Q1 and Q2, and the first resistance R1. Thus the divident of the base-emitter voltage VBE (Q1) of the first transistor Q1 by the resistance value of the first resistance R1 is obtained as the collector current of the second transistor Q2.

$$Ic(Qpl\ 2) = VBE,\ (Q1)/R1 \quad (1)$$

wherein the Ic (Q2) represents the collector current of the second transistor Q2 whereas the base current of each transistor is ignored on assumption that the d.c. current amplification factor hFE of the first, second, third and fifth transistor Q1, Q2, Q3 and Q5 is fully high.

The collector current of the second transistor Q2 is supplied to a current mirror circuit constituted by the third and the fifth transistor Q3, Q5, thereby obtaining the collector current Ic (Q5) at the OUTPUT, the characteristic of which current is decided by the base-emitter voltage of the first transistor Q1. In other words, if the base-emitter junction area of the third transistor Q3 is made equal to that of the fifth transistor Q5, the collector current of the third transistor Q3 becomes equal to that of the fifth transistor Q5.

$$Ic(Q5) = Ic\ Q2) \quad (2)$$

$$Ic(Q5) = VBE(Q1)/R1 \quad (3)$$

The conventional constant-current generating circuit is constituted in the aforementioned manner. The collector current of the first transistor Q1 is decided by the sum of the base-emitter voltages of the first transistor and of the second transistor. Under this system a voltage applied across the both terminals of the resistance R0 is likely to vary dependently on the variations in the source voltage. Consequently, the current flowing through the resistance R0 varies, which causes the collector current of the first transistor to change. As a result, the base-emitter voltage of the first transistor varies. Finally, the current flowing through the first resistance and the load L is likely to change dependently on variations in the source voltage. This is a great disadvantage of the conventional constant-current generating circuits.

OBJECTS AND SUMMARY OF THE INVENTION

It is an object of the present invention to provide an improved constant-current generating circuit capable of producing a constant current independently of variations in the source voltages, and further capable of having the true temperature characteristic of the base-emitter voltage of a transistor as its output current characteristic.

Another object of the present invention is to provide an improved constant-current generating circuit operable at a relatively low source voltage, and capable of minimizing a possible error in supplying a current to the load even when the d.c. current amplification factor of the load-current supplying transistor is low.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to one aspect of the present invention, there is provided a constant-current generating circuit where the base-emitter voltage of a first transistor is highly precisely converted into a current, and this current is used as a current source.

According to another aspect of the present invention, there is provided a constant-current generating circuit where the emitter of a second transistor which constitutes a negative feedback circuit in combination with a first transistor for generating a constant voltage is connected, directly or via a resistance, to the earthing terminal, and the collector current of a third transistor which constitutes a current mirror circuit in combination with a fifth load-current supplying transistor is controlled by the negative feedback circuit.

DETAILED DESCRIPTION OF THE PREFERRED EMBODIMENTS

Figure 1:
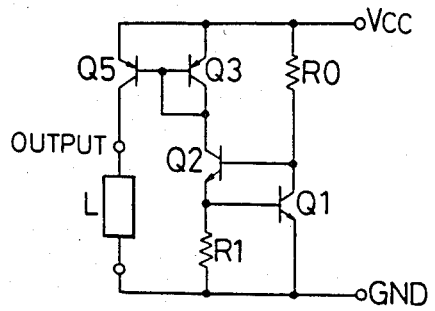
F I G .1.(PRIOR ART)
FIG. 1 is a circuit diagram of a prior art constant-current generating circuit.
Figure 2:
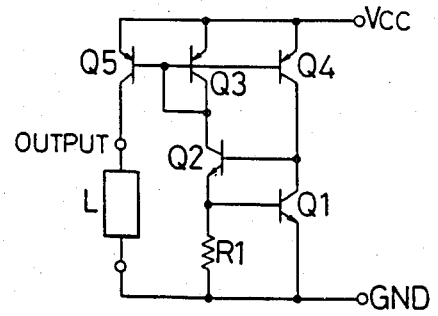
FIG. 2 is a circuit diagram of a first embodiment of the present invention.

Referring to FIG. 2, it will be understood that the resistance R0 in FIG. 1 is replaced by a fourth transistor Q4 of PNP type, wherein the base thereof is connected to that of the third transistor Q3, and wherein the collector thereof is connected to the base of the second transistor Q2. The emitter of the fourth transistor Q4 is connected to the source terminal Vcc. This fourth transistor Q4 constitutes a current mirror circuit in combination with the third transistor Q3.

On assumption that this circuit is effectively operated, the collector current Ic (Q2) of the second transistor Q2 will be decided as the divident of the base-emitter voltage VBE (Q1) of the first transistor Q1 by the resistance value of the first resistance R1:

$$Ic(Q2)=VBE(Q1)/R1 \quad (4)$$

This is the same as the equation (1). At this stage, the bases of the third, the fourth and the fifth transistor Q3, Q4, and Q5 are connected to their respective emitters, thereby constituting a current mirror circuit which has the collector current of the third transistor Q3 as the reference current. As a result, the collector currents Ic (Q4), Ic (Q5) of the fourth transistor Q4 and of the fifth transistor Q5 flow dpendently on the collector current Ic (Q3). Herein, if the base-emitter junction area of the fourth transistor Q4 and that of the fifth transistor Q5 are equalized to that of the third transistor Q3, the collector currents of the fourth and fifth transistors Q4 and Q5 become equal to that of the third transistor Q3. This can be represented by the following equation:

$$Ic(Q3)=Ic(Q2) \quad (5)$$

$$Ic(Q4)=Ic(Q3) \quad (6)$$

$$Ic(Q5)=Ic(Q3) \quad (7)$$

Since the collector of the fifth transistor Q5 is connected to the output terminal OUTPUT, the collector current Ic (Q5) can be represented, on the basis of the equations (5), (6) and (7), by the following equation:

$$Ic(Q5)=VBE(Q1)/R1 \quad (8)$$

This is the same as the equation (3). The collector current Ic (Q1) of the first transistor Q1 is supplied as that of the fourth transistor Q4, and therefore, based on the equations (4), (5) and (7) the following equation is established:

$$Ic(Q1)=VBE(Q1)/R1 \quad (9)$$

The known circuit shown in FIG. 1 has a drawback that the VBE of the first transistor Q1 varies as the collector current thereof varies dependently on variations in the source voltages. However, in the circuit of this embodiment the collector current of the first transistor Q1 is not affected by variations in the source voltage, which will be evident from the equation (9). This means that the characteristic has been improved.

Figure 3:
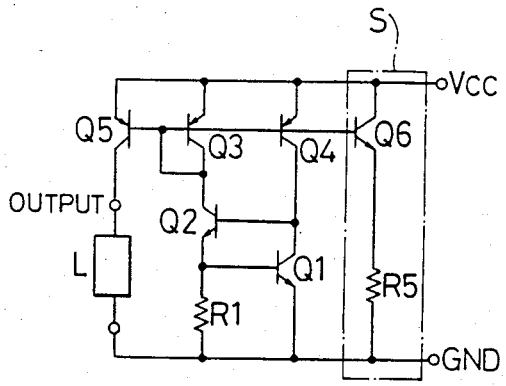
FIG. 3 is a circuit diagram of a second embodiment.

FIG. 3 shows a second embodent of the invention, in which a starter circuit consisting of a sixth transistor Q6 of NPN type and a resistance R5 are added in series to the circuit of FIG. 2. The base of the sixth transistor Q6 is connected to that of the third transistor Q3, and the collector thereof is connected to the source terminal Vcc. The emitter of the sixth transistor Q6 is connected to one of the terminals of the fifth resistance R5, and the other terminal thereof is connected to the earthing terminal GND.

In FIG. 3 the circuit (S) constituted by the sixth transistor Q6 and the fifth resistance R5 is added as a starter circuit for a constant-current generating circuit of the present invention, but it is only an example and any other means can be used for starting the circuit.

In FIG. 3, when the power is turned on, electric currents flow through the emitters of the third, the fourth and the fifth transistors Q3, Q4 and Q5 to the bases thereof, and are supplied to the base of the sixth transistor Q6, from which it further flows through the emitter to the earthing terminal GND via the resistance R5. The fact that the base currents of the third, the fourth, and the fifth transistors Q3, Q4 and Q5 flow makes collector currents flow through each of these transistors, among which the collector current of the fourth transistor Q4 flows through the base of the second transistor Q2 to the emitter thereof, thereby starting the operation of the circuit of FIG. 3. The subsequent operation is the same as that of the first embodiment shown in FIG. 2.

Figure 4:
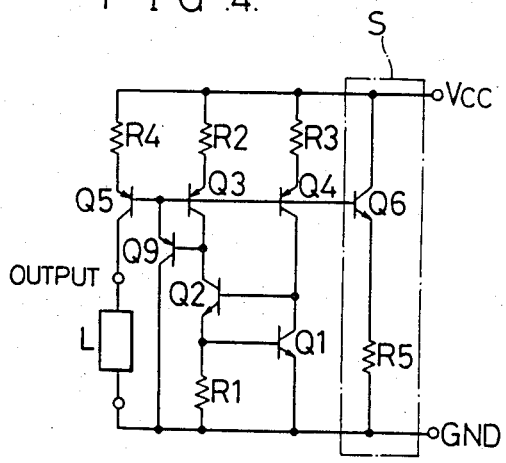
FIG. 4 is a circuit diagram of a third embodiment.

FIG. 4 shows a third embodiment. This embodiment is different from that of FIG. 3, in that a second, a third and a fourth resistance R2, R3 and R4 are provided between each of the emitters of the third, the fourth and the fifth transistors Q3, Q4 and Q5 and the source terminal Vcc, thereby giving rise to a voltage drop in each resistance. In this way the precision of the current mirror circuit is enhanced. In addition, a ninth transistor Q9 of PNP type is provided, whose emitter and base are respectively connected to the base and collector of the third transistor Q3. The collector of the ninth transistor Q9 is earthed. Owing to the provision of the additional transistor Q9, a possible error of the output current value which occurs dependently on the base current of each transistor of the current mirror circuit is minimized, and the precision of the circuit is further improved. The other operation is the same as that of the second embodiment of FIG. 3.

Figure 5:
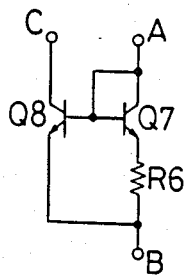
FIG. 5 is a circuit diagram of a compensating circuit adapted to cancel the temperature coefficient of the first resistance occurring in the voltage-current conversion in the circuits of FIG. 1 to 3.

FIG. 5 shows a circuit adapted for connection to the load in the constant-current generating circuit of the invention. This is a compensating circuit which aims at negating the thermal characteristic of the first resistance R1 which is likely to occur when a current dependent on the thermal characteristic of the base-emitter voltage of a transisor is produced. As described above, the present invention is to produce a current dependent on the thermal characteristic of the VBE of a transistor, and the compensating circuit shown in FIG. 5 plays an important role in carrying out the invention.

In FIG. 5 there are provided seventh and eighth transistors Q7 and Q8 of NPN type, and a sixth resistance R6 which has the same structure as that of the first resistance R1. The collector of the seventh transistor Q7 is connected to the terminal (A) to which the collector of the fifth transistor Q5 is connected, and the emitter thereof is connected, via the resistance R6, to the terminal (B), that is, the earthing terminal GND. The base and collector of the seventh transistor Q7 are in diode connection. The collector of the eighth transistor Q8 is connected to a terminal (C), that is, an output terminal, and the emitter thereof is connected to the terminal (B). The base thereof is connected to that of the seventh transistor Q7.

By referring to the equation (8) the voltage drop caused by a current flowing through the sixth resistance R6 can be represented by:

$$VR6 = Ic(Q5) \cdot R6 \quad (10)$$

wherein VR6 represents the voltage drop at the sixth resistance R6, and R6 represents the resistance value of the sixth resistance. By combining the equations (8) and (10), the following equation is established:

$$VR6 = (VBE\ (Q1)/R1) \cdot R6 \quad (11)$$

The sixth resistance R6 has the same structure as that of the first resistance R1, and their temperature coefficients are the same. As evident from the equation (11), the temperature coefficient of the first resistance R1 is negated by that of the sixth resistance R6. As a result, the VR6 is obtained as a voltage having the temperature coefficient of VBE (Q1). Therefore, when the terminal (C) of FIG. 5 is used as an output terminal, a current Ic (Q8) having the true temperature characteristic of the base-emitter voltage of a transistor is obtained.

As described above, in the first to the third embodiments the base-emitter voltage of the first transistor Q1 is precisely converted into a current, and this current is used as a current source. As a result, the output current can be stabilized regardless of variations in the source voltage. In addition, these embodiments can be used as a constant-current source which generates a constant current having the same temperature characteristic as that of the base-emitter voltage of the first transistor Q1.

Figure 6:
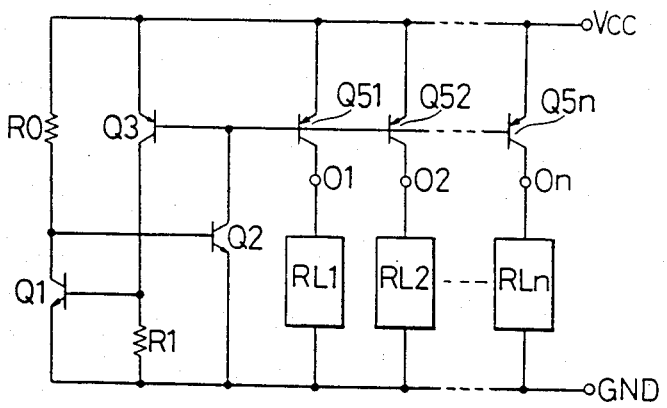
FIG. 6 is a circuit diagram of a fifth embodiment.

FIG. 6 shows a fourth embodiment. The first and the second transistor Q1 and Q2 are NPN types, and the third transistor Q3 and the fifth transistors Q51, Q52, . . . , Q5n are PNP types. The base of the first transistor Q1 is connected to the earthing terminal GND through the first resistance R1, and the collector thereof is connected to the source terminal Vcc through a resistance R0. The emitter thereof is connected to the earthing terminal GND. The first transistor Q1 detects voltage drop at the first resistance R1. The emitter of the second transistor Q2 is directly connected to the earthing terminal GND, and the collector thereof is connected to the bases of the third transistor Q3 and the fifth transistors Q51, Q52, . . . Q5n. The base thereof is connected to the collector of the first transistor Q1. The second transistor Q2 controls the base potential of the third transistor Q3. The collector of the third transistor Q3, which supplies the source current to the first resistance R1, is connected to the junction of the base of the first transistor Q1 and the first resistance R1. The emitter thereof is connected to the source terminal Vcc. The third transistor Q3 constitutes a negative feedback circuit in combination with the transistors Q1 and Q2. Each base of the fifth transistors Q51, . . . , Q5n is connected to the base of the third transistor Q3. Each emitter thereof is connected to the source terminal Vcc. The fifth transistors Q51, . . . , Q5n constitute a current mirror circuit in combination with the third transistor Q3, and each collector is connected to each output terminal 01, 02, . . . , On. Loads RL1, RL2, . . . , RLn are connected between each output terminal 01, 02, . . . , On and the earthing terminal GND, whereby currents are supplied to these loads RL1, . . . , RLn.

The operation of this circuit will be described as follows:

When the power is turned on, a current flows through the resistance R0 and the base and emitter of the second transistor Q2 start the operation of the circuit. Then, a current is supplied from the third transistor Q3 to the first resistance R1 and the base of the first transistor Q1. A voltage drop at the first resistance R1 is detected by the first transistor Q1. The detected output, that is, the collector potential of the first transistor Q1 is transmitted to the base of the seocnd transistor Q2, which amplifies the signal, thereby to control the base potential of the third transistor Q3, and accordingly the collector current thereof.

In this way a negative feedback loop is constituted by the first, the second and the third transistor Q1, Q2 and Q3, and a current obtained by dividing the base-emitter voltage of the first transistor Q1, i.e., VBE (Q1) by the resistance R1 becomes the collector current of the third transistor Q3. At this stage, the base and emitter of the third transistor Q3 are connected to each base and emitter of the transistors Q51, Q52, . . . , Q5n, and the third transistor Q3 constitutes a current mirror circuit in combination with the transistors Q51, Q52, . . . , Q5n. As a result, a current dependent on the base-emitter voltage VBE (Q1) is supplied to the loads RL1, RL2, . . . , RLn which are connected to each collector of the transistors Q51, Q52, . . . , Q5n.

$$Ic(Q3) = VBE(Q1)/R1 \quad (12)$$

wherein the Ic (Q3) represents the collector current of the third transistor Q3, and on assumption that the d.c. current amplification factors hFEs of the first, the second and the third transistor Q1 to Q3, and the fifth transistors Q51, Q52, . . . , Q5n are fully high, the base current of each transistor is ignored.

The collector current of the third transistor Q3 is supplied to each transistor Q51, Q52, . . . , Q5n which constitutes the current mirror circuit with the third transistor Q3, and a current is obtained as a collector current Ic (Q51), Ic (Q52), . . . , Ic (Q5n) of each fifth transistor Q51, Q52, . . . , Q5n at each output terminal 01, 02, . . . , On, wherein the characteristic of the current is decided by the base-emitter voltage of the first transistor Q1. This can be represented by:

$$Ic(Q51) = Ic(Q52) = \ldots = Ic(Q5n) = Ic(Q3) \quad (13)$$

$$VBE(Q1)/R1 = Ic(Q51) = Ic(Q52) = \ldots = Ic(Q5n) \quad (14)$$

As described above, the circuit of the fourth embodiment has the second transistor Q2 whose emitter is directly connected to the earthing terminal GND, and therefore, the collector potential of the first transistor Q1 becomes nearly equal to 1VBE. This means that the circuit can be operated with a dry cell (1.5 volt). The third transistor Q3 is located in the negative feedback loop, thereby ensuring that the collector current thereof is kept constant. As a result, if the current mirror circuit is constituted by lateral PNP transistors having a relatively low d.c. current amplification factor hFE, the influence of the base current can be ignored, and a highly precise constant current can be supplied to each load.

Figure 7:
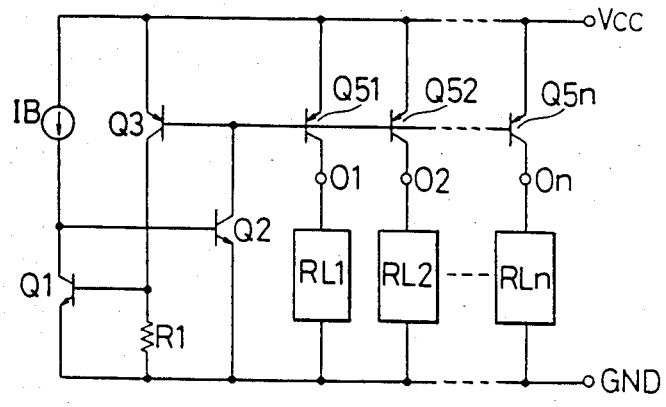
FIG. 7 is a circuit diagram of a sixth embodiment.

FIG. 7 shows a fifth embodiment, which is different from the fourth embodiment of FIG. 6 in that the resistance R0 is replaced by a constant-current source IB. The remaining structures are the same. The operation and effects of the fifth embodiment are the same as those of the fourth embodiment.

Figure 8:
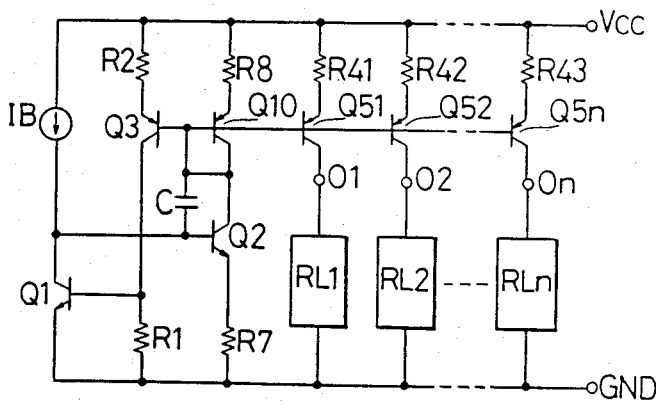
FIG. 8 is a circuit diagram of a seventh embodiment.

FIG. 8 shows a sixth embodiment. This circuit includes a seventh resistance R7 added between the emitter of the second transistor Q2 and the earthing terminal GND in the circuit shown in FIG. 7, a capacitor (C) connected between the base and collector of the second transistor Q2, and a tenth transistor Q10 connected between the collector of the second transistor Q2 and the source terminal Vcc, the tenth transistor Q10 constituting a current mirror circuit in combination with the third transistor Q3. In addition, the second, the eighth, and the fourth resistance R2, R8, and R41, R42, . . . , R4n are connected between each emitter of the third, the tenth, and the fifth transistors Q3, Q10, and Q51, Q52, . . . , Q5n and the source terminal Vcc.

The basic operation of this circuit is the same as that of the fifth embodiment of FIG. 6 and of the sixth embodiment of FIG. 7. The effects are the same as those obtained in the fifth embodiment. Besides, the following effects are obtained:

(1) By virtue of the capacitor (C), the resistance R7 and the transistor Q10, self-oscillation is prevented, and the negative feedback loop is stabilized; and (2) Since the resistance is connected to the emitter of each transistor, the off-set between the base and emitter of each transistor is compensated.

According to the fifth to the seventh embodiments, the emitter of the second transistor constituting a negative feedback circuit in combination with the first transistor for generating a constant-voltage is, directly or via a resistance, connected to the earthing terminal. In addition, the collector current of the third transistor constituting a current mirror circuit in combination with the fifth transistor for supplying a current to the load is controlled by a negative feedback loop. As a result, the circuit can be operated at a relatively low voltage, and a current highly precisely dependent on the base-emitter voltage of a transistor can be supplied.

What is claimed is:

1. A constant-current generating circuit, which comprises:

a first conductivity type first transistor including a first and a second electrode and a base electrode, this first electrode being connected to a first potential point, this second electrode being connected to a second potential point through a load, and this base electrode being connected to said first potential point through a first resistance, thereby detecting voltage drop at this first resistance;

a second conductivity type third transistor including a first and a second electrode and a base electrode, this first electrode being connected to said second potential point, this second electrode being connected to said first potential point through said first resistance;

a first conductivity type second transistor including a first and a second electrode and a base electrode, this base electrode being connected to the second electrode of said first transistor, this first electrode being connected to said first potential point, and this second electrode being connected to the base electrode of said third transistor, thereby controlling the potential at the base electrode of said third transistor dependently on the potential at the second electrode of said first transistor; and a second conductivity type fifth transistor including a first and a second electrode and a base electrode, this base electrode being connected to that of said third transistor, this first electrode being connected to said second potential point, thereby constituting a current mirror circuit in combination with said third transistor, and this second electrode being connected to an output terminal.

2. A constant-current generating circuit as defined in claim 1, wherein said load is a resistance.

3. A constant-current generating circuit as defined in claim 1, wherein said load is a constant-current source.

4. A constant-current generating circuit as defined in claim 1, wherein each first electrode of said third and fifth transistor is connected to a second potential point through a second and a fourth resistance.

5. A constant-current generating circuit, which comprises:

a first conductivity type first transistor including a first and a second electrode and a base electrode, this first electrode being connected to a first potential point, this second electrode being connected to a second potential point through a load, and this base electrode being connected to said first potential point through a first resistance, thereby detecting voltage drop at this first resistance;

a second conductivity type third transistor including a first and a second electrode and a base electrode, this first electrode being connected to said second potential point, this second electrode being connected to said first potential point through said first resistance;

a first conductivity type second transistor including a first and a second electrode and a base electrode, this base electrode being connected to the second electrode of said first transistor, this first electrode being connected to said first potential point through a seventh resistance, and this second electrode being connected to the base electrode of said third transistor, thereby controlling the potential at the base electrode of said third transistor dependently on the potential at the second electrode of said first transistor;

a second conductivity type fifth transistor including a first and a second electrode and a base electrode, this base electrode being connected to that of said third transistor, this first electrode being connected to said second potential point, thereby constituting a current mirror circuit in combination with said third transistor, and this second electrode being connected to an output terminal;

a second conductivity type tenth transistor including a first and a second transistor and a base transistor, this base electrode being connected to that of said third transistor, this first electrode being connected to said second potential point, thereby constituting a current mirror circuit in combination with said third transistor, and this second electrode being connected to that of said second transistor; and a capacitor connected between the second electrode and base electrode of said second transistor.

6. A constant-current generating circuit as defined in claim 5, wherein said load is a resistance.

7. A constant-current generating circuit as defined in claim 5, wherein said load is a constant current source.

8. A constant-current generating circuit as defined in claim 5, wherein each first electrode of said third, fifth and tenth transistor is connected to said second potential point through the second, fourth and eighth resistance.

* * * * *